US011781252B2

(12) United States Patent
Hughes

(10) Patent No.: US 11,781,252 B2
(45) Date of Patent: Oct. 10, 2023

(54) WOVEN PRODUCTS

(71) Applicant: Don & Low Limited, Forfar (GB)

(72) Inventor: John Frederick Hughes, Forfar (GB)

(73) Assignee: Don & Low Limited, Forfar (GB)

( * ) Notice: Subject to any disclaimer, the term of this patent is extended or adjusted under 35 U.S.C. 154(b) by 37 days.

(21) Appl. No.: 16/814,827

(22) Filed: Mar. 10, 2020

(65) Prior Publication Data

US 2020/0347529 A1 Nov. 5, 2020

(30) Foreign Application Priority Data

May 2, 2019 (GB) ..... 1906190

(51) Int. Cl.
*D03D 1/00* (2006.01)
*E01C 13/08* (2006.01)
(Continued)

(52) U.S. Cl.
CPC ..... *D03D 27/06* (2013.01); *D03D 1/00* (2013.01); *D03D 3/005* (2013.01); *D03D 11/00* (2013.01);
(Continued)

(58) Field of Classification Search
CPC ..... D03D 27/06; D03D 3/005; D03D 11/00; D03D 27/04; D03D 27/12; D10B 2503/042
(Continued)

(56) References Cited

U.S. PATENT DOCUMENTS 375,289 A * 12/1887 Heald ..... D03D 11/00 139/414
1,105,503 A * 7/1914 Gaillard ..... D03D 11/00 139/410
(Continued)

FOREIGN PATENT DOCUMENTS

EP 0093096 A2 11/1983
EP 2251467 A1 11/2010
(Continued)

OTHER PUBLICATIONS

"What's the Difference between Polypropylene Types?" Machine Design, Oct. 1, 2018, https://www.machinedesign.com/community/article/21837192/whats-the-difference-between-polypropylene-types. (Year: 2018).*
(Continued)

*Primary Examiner* — Khoa D Huynh
*Assistant Examiner* — Grace Huang
(74) *Attorney, Agent, or Firm* — Perkins Coie LLP

(57) ABSTRACT

Disclosed is a woven product adapted to be used as a primary backing layer for a surface, ground or floor covering comprising artificial or synthetic grass or turf. The woven product comprises at least a first woven layer and a second woven layer, wherein the first and second woven layers are interwoven, the first woven layer comprises a plurality of warp tapes/threads and a plurality of weft tapes/threads, the warp tapes/threads and the weft tapes/threads of the first woven layer being substantially perpendicular to one another. The second woven layer comprises a plurality of warp tapes/threads and a plurality of weft tapes/threads, the warp tapes/threads and the weft tapes/threads of the second woven layer being substantially perpendicular to one another.

15 Claims, 3 Drawing Sheets

(51) Int. Cl.

| | |
|---|---|
| ***D03D 11/00*** | (2006.01) |
| ***D03D 27/06*** | (2006.01) |
| ***D03D 3/00*** | (2006.01) |
| ***D03D 27/04*** | (2006.01) |
| ***D03D 27/12*** | (2006.01) |
| ***D05C 17/02*** | (2006.01) |

(52) U.S. Cl.
CPC ..... *D03D 27/04* (2013.01); *D03D 27/12* (2013.01); *D05C 17/02* (2013.01); *E01C 13/08* (2013.01); *D10B 2503/042* (2013.01)

(58) Field of Classification Search
USPC ..... 139/408
See application file for complete search history.

(56) References Cited

U.S. PATENT DOCUMENTS 2,007,078 A * 7/1935 Crabtree ..... D03D 27/06 15/208
2,063,853 A * 12/1936 Rice ..... D03D 27/12 139/400
2,288,649 A * 7/1942 Robie ..... B24D 11/00 15/208
2,672,169 A * 3/1954 Walters ..... D03D 1/0094 139/408
2,807,286 A * 9/1957 Patrick ..... D03D 27/12 139/401
3,293,103 A 12/1966 Walter et al.
3,885,603 A * 5/1975 Slaughter ..... D21F 1/0036 162/903
4,605,585 A * 8/1986 Johansson ..... D21F 1/0036 162/903
4,617,208 A * 10/1986 Cadenhead, Sr. ..... D02G 1/002 428/17
4,759,976 A * 7/1988 Dutt ..... D21F 1/0036 442/205
5,013,330 A * 5/1991 Durkin ..... D21F 11/006 428/116
6,698,458 B1 * 3/2004 Sollars, Jr. ..... D06N 3/183 442/205
7,025,095 B2 * 4/2006 Zils ..... D21F 1/0036 139/408
7,089,967 B2 * 8/2006 Debaes ..... D03D 27/06 139/21
7,132,376 B2 * 11/2006 Rashed ..... D03D 1/007 442/131
7,874,320 B2 * 1/2011 Knapp ..... D03D 27/00 139/21
8,147,653 B2 * 4/2012 Stone ..... D21F 1/0045 139/425 A
8,651,150 B2 * 2/2014 Siebert ..... D03D 27/02 139/21
9,534,777 B2 * 1/2017 Van Herpen ..... D03D 15/547
9,863,069 B2 * 1/2018 Harabayashi ..... D03D 11/00
10,338,755 B2 * 7/2019 Podhajny ..... G06F 3/044
11,028,507 B2 * 6/2021 Vanderjeugt ..... D03D 13/004
11,091,857 B2 * 8/2021 Siebert ..... D03D 27/10
11,166,644 B2 * 11/2021 Shen ..... D03D 1/0088
2003/0226613 A1 * 12/2003 Debaes ..... D03D 39/10 139/408
2009/0114307 A1 * 5/2009 Jennings ..... F16F 7/006 139/408
2009/0197021 A1 * 8/2009 Jones ..... D03D 15/567 428/17
2010/0248574 A1 9/2010 King et al.
2013/0216770 A1 * 8/2013 Gilbertson ..... D03D 1/00 139/408
2014/0338222 A1 * 11/2014 Song ..... A43B 23/042 12/146 C

FOREIGN PATENT DOCUMENTS

EP 2811056 A1 12/2014
EP 3736362 A1 11/2020
FR 470300 A * 9/1914 ..... D03D 27/06
FR 2455645 A1 * 11/1980 ..... D03D 11/00
GB 492497 A * 9/1938 ..... D03D 11/00
GB 1002230 A 8/1965
GB 1492277 A 11/1977
GB 2585818 B 5/2022
JP H04124301 A 4/1992
WO 2007140950 A1 12/2007

OTHER PUBLICATIONS

Combined Search and Examination Report for counterpart United Kingdom Application No. GB1906190.2; dated Oct. 24, 2019; 7 pages.
Extended European Search Report for counterpart European Application No. 20159568.3; dated Oct. 8, 2020; 8 pages.

* cited by examiner

WOVEN PRODUCTS

CROSS-REFERENCE TO RELATED APPLICATION

This application claims priority to United Kingdom Application No. GB1906190.2, filed May 2, 2019, entitled "IMPROVEMENTS IN AND RELATING TO WOVEN PRODUCTS," which application is Incorporated by reference herein in its entirety.

FIELD OF INVENTION

The present invention relates to a backing or substrate (layer) for a textile product, for example, a surface covering, for example, a tufted surface, covering or carpet such as artificial or synthetic grass or turf. The invention also pertains to a related textile product and to a method of manufacturing a backing or substrate (layer) for a textile product. The textile product may find utility as a sports or leisure surface.

BACKGROUND TO INVENTION

Backing or substrate layers for textile products are known. Such are often referred to as 'primary backing' fabrics or 'primary backings'. Presently, there are several common methods utilised by manufacturers to produce tufted artificial grass 'carpet'. In some instances producers tuft polypropylene or polyethylene 'face' yarns into:

1. A single layer woven primary backing fabric or a single layer nonwoven polyester/glass fibre fleeced primary backing fabric. A single layer primary is often used in domestic or residential 'artificial grass carpet' as a high strength carpet is not required in these areas (see FIG. 1).
2. A combination of two separate layers of primary backing fabric. In such arrangement, two separate layers of primary backing are unwound into a tufting machine and held together during a tufting/needling process (see FIG. 2).
3. A composite multilayer fabric comprising combinations of woven primary backing fabric and/or nonwoven scrims of polypropylene/polyester or glass fibre. In such instance, a single composite primary backing roll is unwound by the tufter into the tufting machine (see FIG. 3).

Once face yarn is tufted into a primary backing fabric, an adhesive coating is applied to the underside of the artificial grass carpet. This is applied by means of a lick roller, a spreading device, spray or foam. This adhesive coating can be latex, polyurethane or resin and bonds the tuft in place once cured. Latex is commonly used, which requires a nonwoven fleece component on the primary backing fabric to act as a sponge to assist adhesion to the fabric and anchor the tufted stitch. Polyurethane adhesive backing is replacing traditional latex. Using polyurethane negates the use of a nonwoven fleece element in the primary backing in preference for a double layer woven primary backing product (see FIGS. 2 and 4).

The finished 'artificial grass carpet' is perforated during the coating/backing process to allow surface water, such as rain water, to pass through the carpet when laid or fitted, on a subsurface or field.

Tuft anchorage, also known as tuft withdrawal force or tuft lock/bind, is a measure of the amount of force, measured in Newtons, required to remove a tuft from a backed/coated carpet. The test method used for measuring this property is ISO 4919.

A double primary backing or composite multi-layer fabric can be used to produce 'artificial grass carpet' for use as sports surfaces where increased carpet strength, dimensional stability and higher tuft anchorage are required.

Currently, single layer woven primary grass backings are supplied to artificial grass manufacturers who can accommodate input of two separate primary backing fabrics into their tufting process (as illustrated in FIG. 2).

Woven fabrics comprise warp tapes (machine-direction) and waft tapes (cross-direction). Warp tapes are supplied to the loom on a beam, whilst weft tapes are woven into the warp tapes from a spool. Polypropylene woven fabric properties are influenced by warp tape tex and density along with weft shotting and weft tex. Typically individual polypropylene woven primary backing products supplied for artificial grass carpets are:

Sixty three weft shots or picks (per 10 cm) plain woven polypropylene primary backing at 134 gsm. Two layers of this primary backing can be used by the tufter for grass primary backing.

Woven leno twist woven fabric—the leno twist fabric is a very lightweight open mesh type fabric. It has a hairy weft yarn and a twist in the warp that is created during the weaving process. It is not designed for strength; its purpose is to assist sticking the latex/polyurethane adhesive backing to the primary backing fabric.

The tufter feeds both of these individual primary backing materials into the tufting machine simultaneously. The process of tufting face yarn through both these individual layers holds them together in the finished carpet (see FIG. 2).

Using two layers of primary backing is believed to deliver a. Increased dimensional stability in the finished 'artificial grass carpet'. This is especially relevant for sports surface applications, such as tennis courts and football pitches, ensuring that tufted coloured marker lines are produced in straight lines.
b. Increased tuft lock or tuft anchorage in the finished (i.e. adhesive backed) 'artificial grass carpet'. The artificial grass 'carpet' is better able to resist the increased wear and tear experienced on sports pitches.
c. Increased tuft anchorage delivered to a 'semi-finished' artificial grass carpet (i.e. before latex/polyurethane adhesive backing) improves its robustness as it is manipulated through the remainder of the production process.
d. Increased pile weights in the face achievable due to greater support from the primary backing. One of the advantages of greater pile weight is enabling of production of artificial grass carpet systems that require little or no infill.
e. Greater finished artificial grass carpet strength. This is important for contact sports or Intensively used sports areas, such as rugby pitches or small sided soccer pitches where there is a lot of impact on the surface.

A multi-layer primary backing composite material falling outside the scope of the invention comprises two separate layers of primary backing (see FIG. 2). In instances where a manufacturer's process allows for two separate primary backing fabrics to be fed into the tufting operation, options are:

two layers of woven polypropylene backing—generally two different fabric (different warp and waft) constructions;

a layer of woven polypropylene plus a layer of woven glass fibre scrim, similar to the woven leno twist fabric described above.

As mentioned above, rolls of each grass primary backing layer are separately unwound into the tufting machine. These layers are held together by the action of the face yarn being tufted through both layers.

A composite, multi-layer, primary backing falling outside the scope of the present Invention is known (see FIG. 3). Where the tufting operation requires a single roll feed of the primary backing material (i.e. a combined product) combinations are:

A layer of plain woven fabric combined with a nonwoven carded fibre fleece (polypropylene or polyester). These two layers are combined together using a needle loom to needlefelt the individual layers together.

Two woven primary backing fabric layers with an additional nonwoven carded fibre fleece (polypropylene or polyester). These layers are combined together using a needle loom to needlefelt the individual layers together.

Two woven primary backing fabric layers stitched together, using robust sewing thread, along the fabrics length, warp direction. This 'stitching' of woven layers to combine two woven primary backing layers is a secondary process, i.e. a post-production process after manufacture of the woven primary backing layers. The intervals between rows of parallel stitches in the length (or warp direction) of the cloth can vary but typically the rows of stitching are approximately 1 cm apart.

It should be noted that the nonwoven carded fibre fleece layer, described above, is the outermost layer when tufted, and such improves bonding of the latex adhesive backing application process.

It is an object of at least one embodiment of at least one aspect of the present invention to obviate or mitigate one or more disadvantages or problems in the prior art.

It is an object of at least one embodiment of at least one aspect of the present invention to provide a two layer woven artificial grass primary backing where both layers of the primary backing are woven and/or combined together (interwoven) in a single step on a weaving loom.

SUMMARY OF INVENTION

According to the present invention there is provided a woven product according to the appended claims.

According to a first aspect of the present invention there is provided a woven product comprising or being adapted for use as a (primary) backing or substrate (layer), for example, for a surface, ground or floor covering such as artificial or synthetic grass or turf. The woven product may comprise at least a first woven layer and a second woven layer. The first and second woven layers may be interwoven, woven, and/or combined (together).

According to the present invention the first and second woven layer may be said to be "self-interwoven".

The first woven layer may comprise a plurality of warp tapes or threads and a plurality of weft tapes or threads. The warp tapes or threads and the weft tapes or threads of the first woven layer may be substantially perpendicular to one another.

The second woven layer may comprise a plurality of warp tapes or threads and a plurality of weft tapes or threads. The warp tapes or threads and the weft tapes or threads of the second woven layer may be substantially perpendicular to one another;

The warp tapes or threads of the first and second woven layers may be substantially parallel to one another.

The weft tapes or threads of the first and second woven layers may be substantially parallel to one another.

Each interwoven area or interweave may comprise one or more of:

a weft tape(s) or thread(s) of the first woven layer and a transversely coincident weft tape(s) or thread(s) of the second woven layer which are passed over both a warp tape(s) or thread(s) of the first woven layer and a (longitudinally coincident) warp tape(s) or thread(s) of the second woven layer; and/or an adjacent weft tape(s) or thread(s) of the first woven layer and an adjacent and transversely coincident weft tape(s) or thread(s) of the second woven layer which are passed under both said warp tape(s) or thread(s) of the first woven layer and said (longitudinally coincident) warp tape(s) or thread(s) of the second layer.

The woven product may find particular utility as a backing for a product, such as artificial or synthetic grass or turf.

The woven product may be referred to as a 'primary backing'.

The woven product preferably comprises, for example solely comprises, the first and second woven layers.

The first and second woven layers may be adjacent or substantially parallel to one another. In use, one of the first or second woven layers may be (disposed) above or below the other of the second or first woven layers.

The first and second woven layers may be interwoven (together) at or by lines of interweaving. A plurality of lines of interweaving may be provided, which may be substantially parallel to one another, and which may be spaced, for example substantially equally spaced, for example by 15 cm to 25 cm, for example around 20 cm.

The first woven layer may comprise a plurality of warp tapes (or threads). The first woven layer may comprise a plurality of weft tapes (or threads). The warp tapes and the weft tapes of the first woven layer may be substantially perpendicular to one another.

The second woven layer may comprise a plurality of warp tapes (or threads). The second woven layer may comprise a plurality of weft tapes (or threads). The warp tapes and the weft tapes of the second woven layer may be substantially perpendicular to one another.

The warp tapes of the first and second woven layers may be substantially parallel to one another. The weft tapes of the first and second woven layers may be substantially parallel to one another.

The first and second woven layers may be interwoven together by the weft and/or warp tapes of the first woven layer and/or by the weft and/or warp tapes of the second woven layer.

The interweave may comprise portions, areas and/or lines of interweave.

The interweave, for example interwoven portions or areas (or lines), may be provided along a warp-direction and may be elongate.

In one advantageous implementation each interwoven portion or area or interweave may comprise one or more of:

weft tape(s) of the first woven layer and a (transversely coincident) weft tape(s) of the second woven layer being passed over and/or under both a warp tape(s) of the first woven layer and a (longitudinally coincident) warp tape(s) of the second woven layer.

In said advantageous implementation the/each adjacent interwoven area or Interweave may comprise an adjacent weft tape(s) of the first woven layer and an adjacent (and transversely coincident) weft tape(s) of the second woven layer being passed under and/or over both said warp tape(s) of the first woven layer and said (longitudinally coincident) warp tape(s) of the second layer.

In one advantageous implementation a/each interwoven portion or area may comprise a weft tape of the first woven layer and a (transversely coincident) weft tape of the second woven layer being passed over and/or under (both) a warp tape of the first woven layer and a (longitudinally coincident) warp tape of the second woven layer.

In said advantageous implementation the/a/each interwoven portion or area may comprise said weft tape of the first woven layer and said (transversely coincident) waft tape of the second woven layer being (passed) under and/or over (both) an adjacent warp tape of the first woven layer and an adjacent (longitudinally coincident) warp tape of the second woven layer.

In said advantageous implementation the/an/each/an adjacent interwoven portion or area may comprise said/an adjacent weft tape of the first woven layer and said/an adjacent (and transversely coincident) weft tape of the second woven layer being (passed) over and/or under (both) said adjacent warp tape of the first woven layer and said adjacent (longitudinally coincident) warp tape of the second layer.

In said advantageous implementation the/an/each/an adjacent interwoven portion or area may comprise said/each adjacent weft tape of the first woven layer and said/said adjacent (and transversely coincident) weft tape of the second woven layer being (passed) under and/or over (both) said warp tape of the first woven layer and said warp tape of the second woven layer.

In one advantageous implementation a/each interwoven portion or area may comprise a weft tape of the first woven layer and a (transversely coincident) weft tape of the second woven layer being passed on one side of both a warp tape of the first woven layer and a (longitudinally coincident) warp tape of the second woven layer.

In said advantageous implementation the/a/each interwoven portion or area may comprise said weft tape of the first woven layer and said (transversely coincident) weft tape of the second woven layer being (passed) on another (opposing) side of both an adjacent warp tape of the first woven layer and an adjacent (longitudinally coincident) warp tape of the second woven layer.

In said advantageous implementation the/an/each/an adjacent interwoven portion or area may comprise said/an adjacent weft tape of the first woven layer and said/an adjacent (and transversely coincident) weft tape of the second woven layer being (passed) on said side of both said adjacent warp tape of the first woven layer and said adjacent (longitudinally coincident) warp tape of the second layer.

In said advantageous implementation the/an/each/an adjacent interwoven portion or area may comprise said/each adjacent weft tape of the first woven layer and said/said adjacent (and transversely coincident) weft tape of the second woven layer being (passed) on said another (opposing) side of both said warp tape of the first woven layer and said warp tape of the second woven layer.

It will thus be appreciated that in said advantageous implementation(s) a/each interweave or interwoven portion or area or region may comprise a pair of weft tapes, a pair of adjacent weft tapes, a pair of warp tapes, and a pair of adjacent warp tapes.

One weft/warp tape of each pair may come from the first woven layer, and another weft/warp tape of each pair may come from the second woven layer.

The woven product may be said to be 'interwoven' or combined, for example by the warp tapes and/or weft tapes.

The warp tapes and/or the weft tapes may be substantially planar.

The woven product, and/or first and/or second woven layer, and/or warp and or weft tapes of the first and/or second woven layers may comprise or consist of a polymer or polymer material or a polyolefin material, for example polypropylene. The polymer material may comprise a homopolymer.

The woven product may comprise a backing layer (for example 'primary backing') for a textile product of tufted product.

The textile product or tufted product may comprise an upper or outer layer or pile tufted and/or attached to the woven product.

The upper or outer layer or pile may comprise a plurality of tufts, for example twisted or spirally wrapped tufts.

The/each tuft may comprise or provide a blade of artificial/synthetic grass,

The/each tuft may comprise a yarn, face yarn or further tape.

The/each tuft may comprise or consist of a further polymer or polymeric material or a polyolefin material, for example polypropylene. The further polymeric material may comprise a homopolymer. The further polymeric material may comprise a/the same material as the polymeric material.

The woven product may be rollable.

According to a second aspect of the present invention there is provided a textile product or tufted product, for example a surface, ground or floor covering, comprising a woven product according to the first aspect of the present Invention.

Advantageously the textile product or tufted product may comprise or may be adapted to comprise a sports surface, for example a playing surface. Alternatively the textile product or tufted product may comprise a leisure surface.

The tufted product may advantageously comprise artificial grass or may alternatively comprise carpet.

According to a third aspect of the present invention there is provided a method of making a woven product comprising a backing or substrate (layer), for example for a surface, ground or floor covering, the method comprising:

weaving or forming a first woven layer;

weaving or forming a second woven layer;

interweaving, weaving or combining the first and second woven layers together.

Preferably the steps of weaving or forming the first woven layer, weaving or forming the second woven layer, and interweaving the first and second layers together are done or performed simultaneously.

According to a fourth aspect of the present invention there is provided use of a woven product as a backing or substrate (layer), for example, for a surface, ground or floor covering, the woven product comprising a first woven layer and a second woven layer, wherein the first and second woven layers are interwoven, woven or combined together.

According to another aspect a woven product Is adapted to be used as a primary backing layer for a surface, ground or floor covering comprising artificial or synthetic grass or turf. The woven product comprises at least a first woven layer and a second woven layer, wherein the first and second woven layers are interwoven, the first woven layer comprises a plurality of warp tapes/threads and a plurality of weft tapes/threads, the warp tapes/threads and the weft tapes/threads of the first woven layer being substantially perpendicular to one another. The second woven layer comprises a plurality of warp tapes/threads and a plurality of weft tapes/threads, the warp tapes/threads and the weft tapes/threads of the second woven layer being substantially perpendicular to one another. The warp tapes/threads of the first and second woven layers are substantially parallel to one another. The weft tapes/threads of the first and second woven layers are substantially parallel to one another. Each interwoven portion or area comprises one or more of: a weft tape(s)/thread(s) of the first woven layer and a transversely coincident weft tape(s)/thread(s) of the second woven layer which are passed over both a warp tape(s)/thread(s) of the first woven layer and a longitudinally coincident warp tape(s)/thread(s) of the second woven layer; and an adjacent weft tape(s)/thread(s) of the first woven layer and an adjacent and transversely coincident weft tape(s)/thread(s) of the second woven layer which are passed under both said warp tape(s)/thread(s) of the first woven layer and said longitudinally coincident warp tape(s)/thread(s) of the second layer.

It will be appreciated that any features of any of the aforementioned aspects of the present invention may be used either singly or in combination with any other features of any of the aforementioned aspects of the present invention.

BRIEF DESCRIPTION OF DRAWINGS

An embodiment of the present invention will now be described by way of example only, and with reference to the accompanying drawings, which are.

DETAILED DESCRIPTION OF DRAWINGS

Referring to FIGS. 1 to 4, there are shown first to fourth textile products comprising primary backing layers as hereinbefore described falling outside the scope of the present invention.

Figure 1:
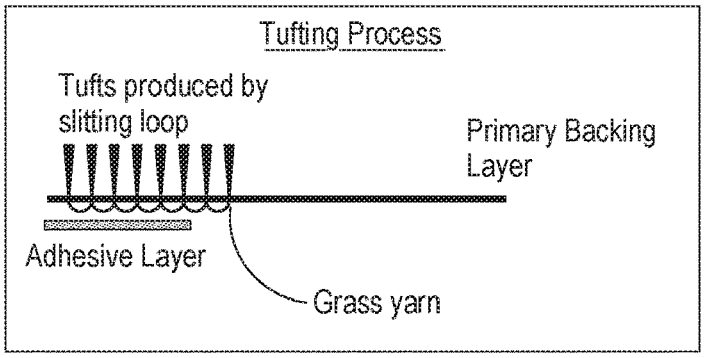
FIG. 1 a schematic side view of a first textile product comprising a primary backing layer falling outside of the scope of the present invention.
Figure 2:
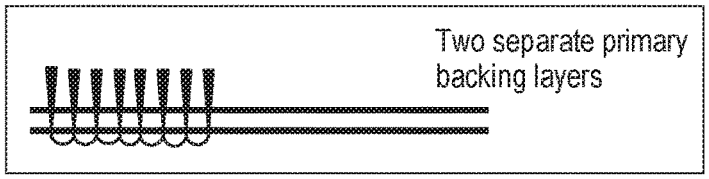
FIG. 2 a schematic side view of a second textile product comprising a primary backing layer falling outside of the scope of the present invention.
Figure 3:
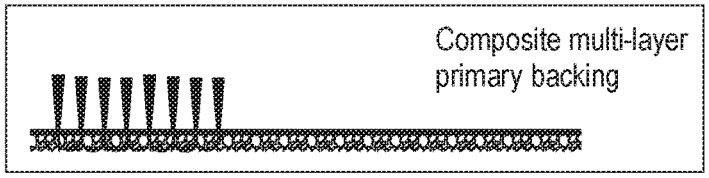
FIG. 3 a schematic side view of a third textile product comprising a primary backing layer falling outside of the scope of the present invention.
Figure 4:
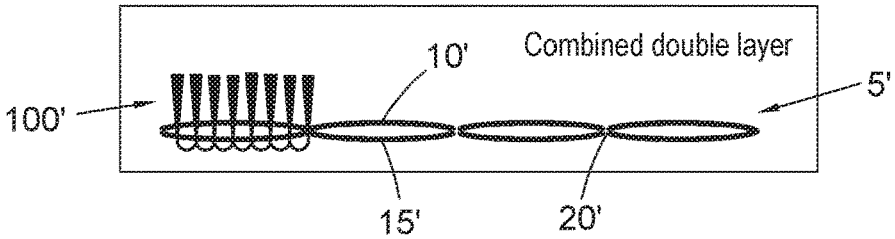
FIG. 4 a schematic side view of a fourth textile product comprising a primary backing layer falling outside of the scope of the present invention.

Referring particularly to FIG. 4, there is shown a textile or woven product, generally designated 5', comprising a primary backing layer falling outside of the scope of the present invention. The woven product 5' comprises and/or is adapted for use as a backing or substrate (layer). The woven product 5' comprises at least a first woven layer 10' and a second woven layer 15'. After the first woven layer 10' and second woven layer 15' are separately woven, the layers 10', 15' are stitched together by stitching 20' comprising threads which are not tapes or threads of the layers 10' 15'. The woven product 5' is used as a backing for a tufted product 100'.

Referring now to FIGS. 5 to 8(*b*), there is shown a textile or woven product, generally designated 5, comprising a primary backing layer according to an embodiment of the present invention. The woven product 5 comprises and/or is adapted for use as a backing or substrate (layer), for example for a surface, ground or floor covering, such as artificial or synthetic grass or turf. The woven product 5 comprises at least a first woven layer 10 and a second woven layer 15, wherein the first and second woven layers 10, 15 are interwoven together at an interwoven region, portion or area 20.

The woven product 5 can typically be referred to as a 'primary backing'.

The woven product 5 comprises, and beneficially solely comprises, the first and second woven layers 10, 15. The first and second layers 10, 15 are adjacent or substantially parallel to one another. In use, one of the first or second layers 10, 15 is (directly) above or below the other of the second or first layers 15, 10.

The first and second layers 10, 15 are interwoven together at or by lines of interweaving 20. A plurality of lines of interweaving 20 are provided, which are substantially parallel to one another, and which are spaced, for example substantially equally spaced, for example by 15 cm to 25 cm, for example around 20 cm.

The first woven layer 10 comprises a plurality of warp tapes 25. The first woven layer 10 comprises a plurality of weft tapes 30. The warp tapes 25 and the weft tapes 30 of the first woven layer 10 are substantially perpendicular to one another.

The second woven layer 15 comprises a plurality of warp tapes 35. The second woven layer 15 comprises a plurality of waft tapes 40. The warp tapes 35 and the weft tapes 40 of the second woven layer 15 are substantially perpendicular to one another.

The warp tapes 25, 35 of the first and second woven layers 10, 15 are substantially parallel.

The weft tapes 30, 40 of the first and second woven layers 10, 15 are substantially parallel.

The first and second woven layers 10, 15 are interwoven together by the weft and warp tapes 30 (25) of the first woven layer 10 and by the weft and warp tapes 40 (35) of the second woven layer 15.

In one advantageous Implementation each Interwoven area or interweave comprises a weft tape 30 of the first woven layer 10 and a (transversely coincident) weft tape 40 of the second weft layer 15 being passed over and/or under both a warp tape 25 of the first woven layer and a (longitudinally coincident) warp tape 35 of the second woven layer 15.

In said advantageous implementation the/each adjacent interwoven area or interweave comprises an adjacent weft tape 30 of the first woven layer 10 and an adjacent (and transversely coincident) weft tape 40 of the second woven layer 15 being passed under and/or over an adjacent warp tape 25 of the first woven layer 10 and an adjacent (longitudinally coincident) warp tape 35 of the second layer 15.

It will thus be appreciated that in said advantageous implementation each interwoven area comprises a pair of weft tapes 30, 40, a pair of adjacent weft tapes 30, 40, a pair of warp tapes 25, 35, and a pair of adjacent warp tapes 25, 35.

One weft/warp tape 25, 30 of each pair come from the first woven layer 10, and another weft/warp tape 35, 40 of each pair comes from the second woven layer 15.

The woven product 35, 40 can be said to be 'interwoven' or combined, for example by weft and warp tapes 25, 30, 35, 40.

The warp and/or the weft tapes 25, 30, 35, 40 are substantially planar.

The woven product 5 and/or first and/or second woven layer 10, 15, and/or warp and/or weft tapes 25, 30, 35, 40 of the first and/or second woven layers 10, 15 comprise or consist of a polymer or polymeric material or a polyolefin material, for example polypropylene. The polymeric material can comprise a homopolymer.

The woven product 5 comprises a backing layer (for example 'primary backing') for a textile product or tufted product. The textile product or tufted product comprises an upper or outer layer or pile tufted and/or attached to the woven product 5.

The upper or outer layer or pile comprises a plurality of tufts, for example twisted and/or spirally wrapped tufts. Each tuft comprises or provides a blade of artificial/synthetic grass. Each tuft comprises a yarn (face yarn) or further tape. Each tuft comprises or consists of a further polymer or polymeric material or a polyolefin material, for example polypropylene. The further polymeric material can comprise a homopolymer. The further polymeric material advantageously comprises a/the same material as the polymeric material.

The woven product 5 is rollable.

The present invention provides a textile product or tufted product generally designated 100, for example a surface, ground or floor covering, comprising a woven product 5 as hereinbefore described.

Advantageously the textile product or tufted product 100 comprises or is adapted to comprise a sports surface, for example a playing surface. Alternatively the textile product or tufted product comprises a leisure surface. The tufted product advantageously comprises artificial or synthetic grass or turf or can comprise carpet.

The present invention provides a method of making a woven product 5 comprising a backing or substrate (layer), for example for a surface, ground or floor covering such as artificial grass, the method comprising:

weaving or forming a first woven layer 10;

weaving or forming a second woven layer 15;

interweaving the first and second woven layers together.

The steps of weaving or forming the first woven layer, weaving or forming the second woven layer, and interweaving the first and second layers together are done or performed simultaneously.

The present invention provides use of the woven product 5 as a backing or substrate (layer), for example for a surface, ground or floor covering, the woven product 5 comprising a first woven layer 10 and a second woven layer 15, wherein the first and second woven layers 10, 15 are interwoven together.

Figure 5:
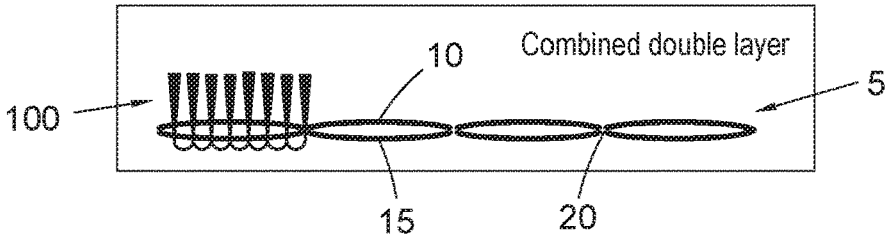
FIG. 5 a schematic side view of a textile product comprising a primary backing layer according to an embodiment of the present invention.

The Applicant has developed a weaving process that allows two woven polypropylene primary backing materials to be simultaneously both woven and combined (interwoven) together in a single stage during weaving (see FIG. 5).

The resulting two layer fabric is designed to deliver required dimensional stability, strength and Improved tuft lock required in a single roll, comprising a combined double layer woven product. The Applicant has Identified that producing a composite woven primary backing, with the two layers joined together on the loom, addresses a disadvantage of other composite primary backing rolls (either stitched or needled together, as per the examples of FIGS. 1 to 4)—variable tension or fabric differences between the layers, causing dimensional Instability or wrinkles in the primary backing either during feeding, tufting or adhesive coating/backing. An advantage of the Applicant's system is that the double layer fabric is produced in one step on the weaving loom, which acts to eliminate tension or fabric differences and reduces the number of process steps. There is also a reduction in energy consumption by reducing number of process steps. An additional advantage of using the process according to the present invention is that the entire primary backing is 100% of one material, for example polypropylene, and is, therefore, able to be recycled.

Embodiments of the invention provide a composite two-layer woven polypropylene fabric intended for use as grass primary backing.

The Applicant previously manufactured a single layer for grass backing which was combined with an additional primary backing layer by the tufter during the grass tufting process. Typical woven fabric construction of a single layer woven grass primary backing is:

134 grams/metre$^2$.

Warp tape and density—56 tex @ 94 warp ends/10 cm.

Weft tape and density—122 tex @ 63 shot/10 cm.

Normal weaving practice is to weave fabric from a single warp beam, or in heavier/denser fabric applications a double warp beam can be used. The use of a double warp beam reduces the number of changeovers and prevents the large volume of warp tapes crushing together, giving a flatter smooth beam which in turn gives a smooth finish to the finished fabric.

What the Applicant has achieved is to weave two layers of single layer grass primary woven backing, as described above, simultaneously on one loom, whilst also simultaneously interweaving these layers together using the weft and warp tapes, all in a single step. The loom incorporates technology using two warp beams, feeding the loom in combination with the set-up of the shafts and tappets on the loom.

To illustrate this, take the example of a single layer woven grass primary backing at 134 grams/metre$^2$ with 94 warp ends/10 cm and a weft shotting of 63 shots/10 cm. When weaving and combining two layers of this grass primary backing on a loom with the required configuration gives:

268 grams/metre$^2$.

Warp tape and density—56 tex @ 188 warp ends/10 cm.

Weft tape and density—122 tex @ 126 shot/10 cm.

Figure 6:
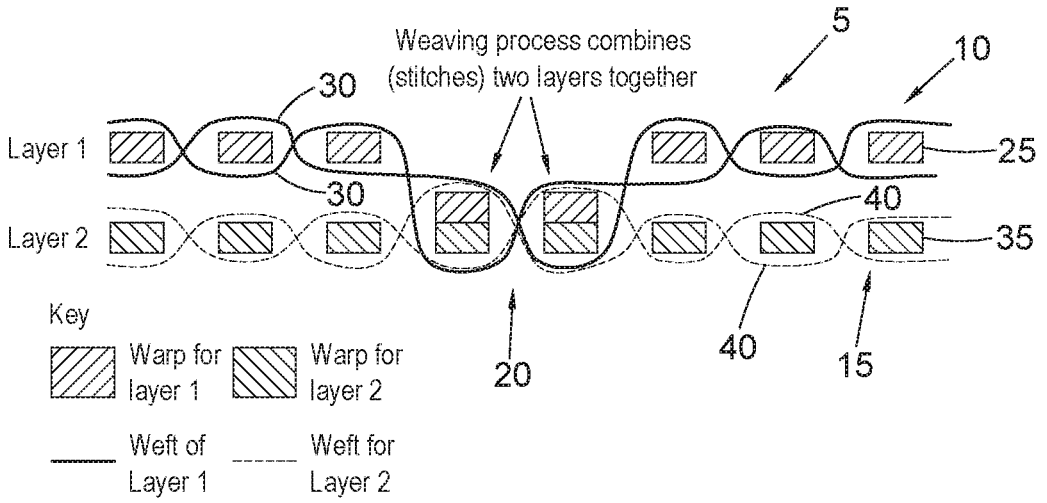
FIG. 6 a more detailed side view to an enlarged scale of the primary backing layer of FIG. 5.
Figure 7:
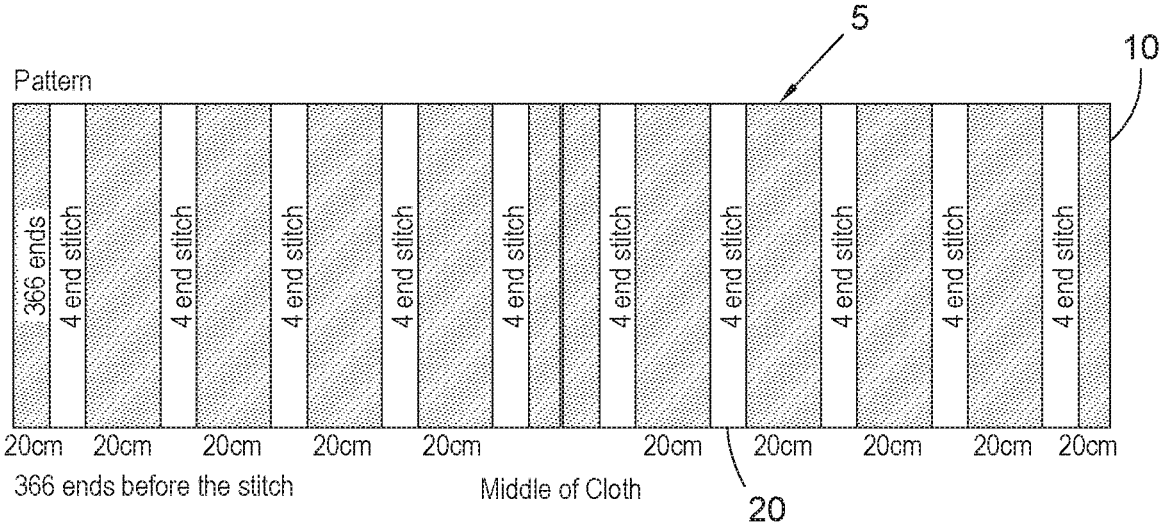
FIG. 7 a top view of the primary backing layer of FIG. 5.
Figure 8A:
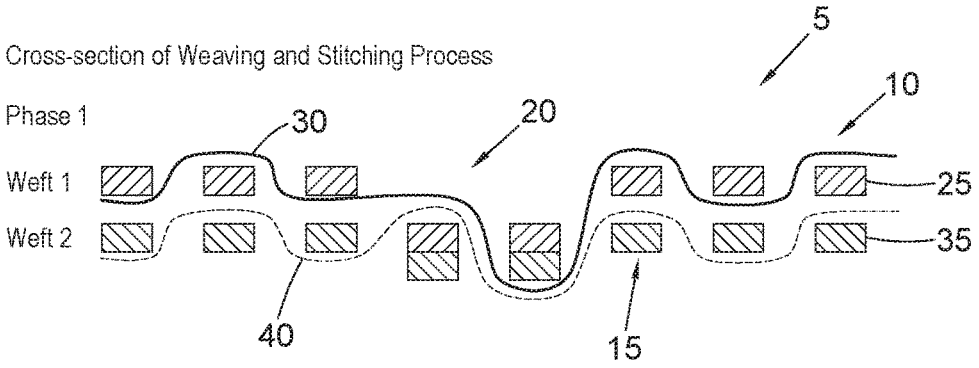
FIGS. 8(*a*) and (*b*) further detailed side view to an enlarged scale of the first and second stages in forming an interwoven area in the primary backing layer of FIG. 5.
Figure 8B:
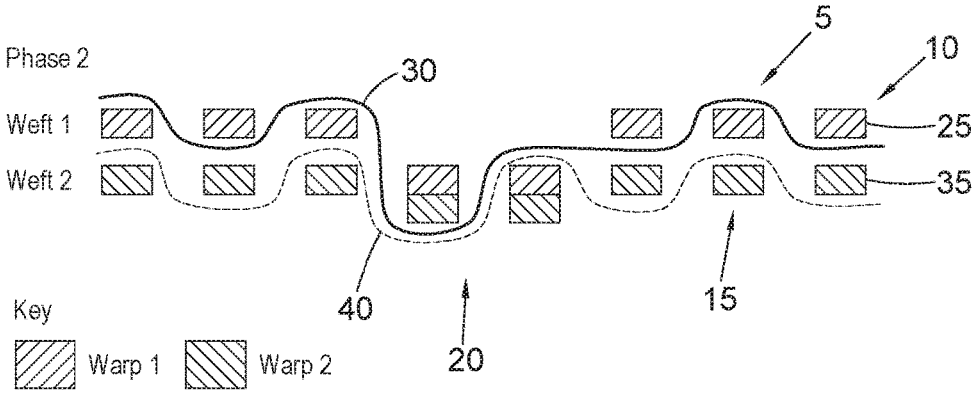

As grass primary backing fabrics are wide, typically between 420 cm and 477 cm wide, the 2 layers of grass primary on the loom have a interwoven area (or seam) every 20 cms to maintain the integrity of the woven 2 layer fabric (see FIGS. 5 and 6).

It is the configuration of the shafts and tappets on the weaving loom that allows a two layer fabric to be simultaneously woven and combined (interwoven) using the weft and warp tapes, specifically:

Two SELVEDGE Shafts with 1/1 tappet configuration interweaving the edges of fabric.

Two SEAL (or Interweaving) Shafts with 2/2 tappet configuration interweaving the body of fabric together.

Four GROUND Shafts with alternating 3/1 and 1/3 tappet configuration weaving both fabrics.

TOTAL of eight SHAFTS required.

This fabric can be woven with either a woven edge or melt selvedge edge, to provide a bond at the fabric edges, depending on customer requirements. A woven selvedge edge is required when strength is needed at the selvedge edge, typically used when tufting close to the full width of the fabric. The stronger edge gives support to the cloth during the tufting and adhesive backing process. Mechanical grippers are often used in the latex/polyurethane adhesive backing process, a woven selvedge provides the robustness required to withstand these mechanical grippers.

It will be appreciated that the embodiment of the present invention hereinbefore described is given by way of example only, and is not meant to be limiting of the scope of the invention in any way.

It will also be appreciated that embodiments of the present invention provide for joining (interweaving) of two layers of woven fabric at intermittent points, areas or regions in situ, utilising warp and/or weft tapes (or threads) of the two layers during simultaneous weaving of the two layers so as to form a (primary) backing layer.

The invention claimed is:

1. A woven product adapted to be used as a backing for a surface, ground or floor covering, the woven product comprising at least a first woven layer and a second woven layer, wherein the first and second woven layers are interwoven at interwoven areas, wherein:

the first woven layer comprises a plurality of warp tapes or threads and a plurality of weft tapes or threads, the warp tapes or threads and the weft tapes or threads of the first woven layer being substantially perpendicular to one another;

the second woven layer comprises a plurality of warp tapes or threads and a plurality of weft tapes or threads, the warp tapes or threads and the weft tapes or threads of the second woven layer being substantially perpendicular to one another;

the warp tapes or threads of the first and second woven layers are substantially parallel to one another; and the weft tapes or threads of the first and second woven layers are substantially parallel to one another; and wherein each interwoven area comprises one or more of:

a weft tape or thread of the first woven layer and a transversely coincident weft tape or thread of the second woven layer which are passed over both a warp tape or thread of the first woven layer and a longitudinally coincident warp tape or thread of the second woven layer; and an adjacent weft tape or thread of the first woven layer and an adjacent and transversely coincident weft tape or thread of the second woven layer which are passed under both said warp tape or thread of the first woven layer and said longitudinally coincident warp tape or thread of the second layer.

2. The woven product as claimed in claim 1, wherein:

the woven product consists of the first and second woven layers.

3. The woven product as claimed in claim 1, wherein the first and second layers are interwoven together at or by lines of interweaving, wherein a plurality of portions, areas or lines of interweaving are provided substantially parallel to one another.

4. The woven product as claimed in claim 1, wherein each interwoven area comprises a pair of weft tapes or threads, a pair of adjacent weft tapes or threads, a pair of warp tapes or threads, and a pair of adjacent warp tapes or threads, one weft/warp tape or thread of each pair being provided from the first woven layer, and another weft/warp tape or thread of each pair being provided from the second woven layer.

5. The woven product as claimed in claim 1, wherein at least one of: the woven product, first woven layer, second woven layer, warp/weft tapes or threads of the first woven layer, and the second woven layer comprise or consist of a polymer or polymeric material or a polyolefin material.

6. The woven product as claimed in claim 1, wherein the woven product is capable of being provided with tufts.

7. The woven product as claimed in claim 1, wherein:

the first and second layers are adjacent or substantially parallel to one another, one of the first or second layers being above, below, adjacent or abutting the other of the second or first layers.

8. A textile product or tufted product for a surface, ground or floor covering, comprising the woven product according to any of claim 1.

9. The textile product or tufted product as claimed in claim 8, comprising an upper or outer layer of pile or face yarn tufted and/or attached to the woven product.

10. The textile product or tufted product as claimed in claim 9, wherein the upper or outer layer of pile comprises a plurality twisted and/or spirally wrapped tufts.

11. The textile product or tufted product as claimed in claim 10, wherein each tuft comprises or provides a blade of artificial/synthetic grass.

12. The textile product or tufted product as claimed in claim 8, comprising an upper or outer layer of yarn, face yarn, or further tape or thread tufted to the woven product.

13. The textile product or tufted product as claimed in claim 8, comprising an upper or outer layer of pile or face yarn tufted to the woven product, wherein each tuft comprises or consists of a polymer or polymeric material.

14. A method of making a woven product, for example, for a surface, ground or floor covering, the method comprising the steps of:

weaving or forming a first woven layer;

weaving or forming a second woven layer;

interweaving the first and second woven layers at interwoven areas, wherein the first woven layer comprises a plurality of warp tapes or threads and a plurality of weft tapes or threads, the warp tapes or threads and the weft tapes or threads of the first woven layer being substantially perpendicular to one another;

the second woven layer comprises a plurality of warp tapes or threads and a plurality of weft tapes or threads, the warp tapes or threads and the weft tapes or threads of the second woven layer being substantially perpendicular to one another;

the warp tapes or threads of the first and second woven layers are substantially parallel to one another; and the weft tapes or threads of the first and second woven layers are substantially parallel to one another; and wherein each interwoven area comprises one or more of:

a weft tape or thread of the first woven layer and a transversely coincident weft tape or thread of the second woven layer which are passed over both a warp tape or thread of the first woven layer and a longitudinally coincident warp tape or thread of the second woven layer; and an adjacent weft tape or thread of the first woven layer and an adjacent and transversely coincident weft tape or thread of the second woven layer which are passed under both said warp tape or thread of the first woven layer and said longitudinally coincident warp tape or thread of the second layer.

15. The method of making the woven product as claimed in claim 14, wherein the steps of weaving or forming the first woven layer, weaving or forming the second woven layer, and interweaving the first and second layers together are done or performed simultaneously.

* * * * *